US007334648B2

(12) United States Patent
Arimura

(10) Patent No.: US 7,334,648 B2
(45) Date of Patent: Feb. 26, 2008

(54) ROTARY IMPACT POWER TOOL

(75) Inventor: Tadashi Arimura, Kyoto (JP)

(73) Assignee: Matsushita Electric Works, Ltd., Kadoma-shi ( * ) Notice: Subject to any disclaimer, the term of this patent is extended or adjusted under 35 U.S.C. 154(b) by 0 days.

(21) Appl. No.: 11/475,947

(22) Filed: Jun. 28, 2006

(65) Prior Publication Data

US 2007/0000676 A1 Jan. 4, 2007

(30) Foreign Application Priority Data

Jun. 30, 2005 (JP) ..... 2005-192649

(51) Int. Cl.
*B25B 21/02* (2006.01)

(52) U.S. Cl. ..... 173/179; 173/176; 173/2

(58) Field of Classification Search ..... 173/2–11, 173/176–183

See application file for complete search history.

(56) References Cited

U.S. PATENT DOCUMENTS 3,974,685 A * 8/1976 Walker ..... 73/761
4,793,421 A * 12/1988 Jasinski ..... 175/27
5,014,793 A * 5/1991 Germanton et al. ..... 173/181
5,154,242 A * 10/1992 Soshin et al. ..... 173/178
5,156,221 A * 10/1992 Breitenmoser ..... 173/1
5,353,882 A * 10/1994 Inoue et al. ..... 173/176
5,563,482 A * 10/1996 Shaw et al. ..... 318/272
5,731,673 A * 3/1998 Gilmore ..... 318/432
6,484,814 B2 * 11/2002 Bongers-Ambrosius ..... 173/2
6,680,595 B2 * 1/2004 Ito ..... 318/434
7,155,986 B2 * 1/2007 Kawai et al. ..... 73/862.21
2003/0047331 A1 * 3/2003 Henderson et al. ..... 173/4
2005/0263305 A1 * 12/2005 Shimizu et al. ..... 173/2

FOREIGN PATENT DOCUMENTS

JP 2005-137134 5/2005

* cited by examiner

*Primary Examiner*—Rinaldi I. Rada
*Assistant Examiner*—Lindsay Low
(74) *Attorney, Agent, or Firm*—Edwards Angell Palmer & Dodge LLP

(57) ABSTRACT

A impact power tool includes a motor rotating a drive shaft, an output shaft holding a tool bit, and a hammer coupled to the drive shaft. The hammer is rotatable together with the drive shaft and is engageable with an anvil fixed to the output shaft so as to give a rotary impact to the output shaft. The tool includes a speed commander generating a target speed intended by a user, and a speed detector for detection of a speed of the drive shaft. A speed controller generates a control signal for driving the motor by referring to the target speed and the detected speed. The speed controller provides a detection time frame, and to adopt a predefined pseudo-detection speed as a substitute for the detected speed when no speed detection is available within the detection time frame. Accordingly, even if no speed detection continues, i.e., the motor is stalled over the detection time frame, the speed controller can successfully generate the control signal by making the use of the pseudo-detection speed, thereby continuing to rotate the drive shaft for generating the impact regularly and consistently without causing a delay.

9 Claims, 6 Drawing Sheets

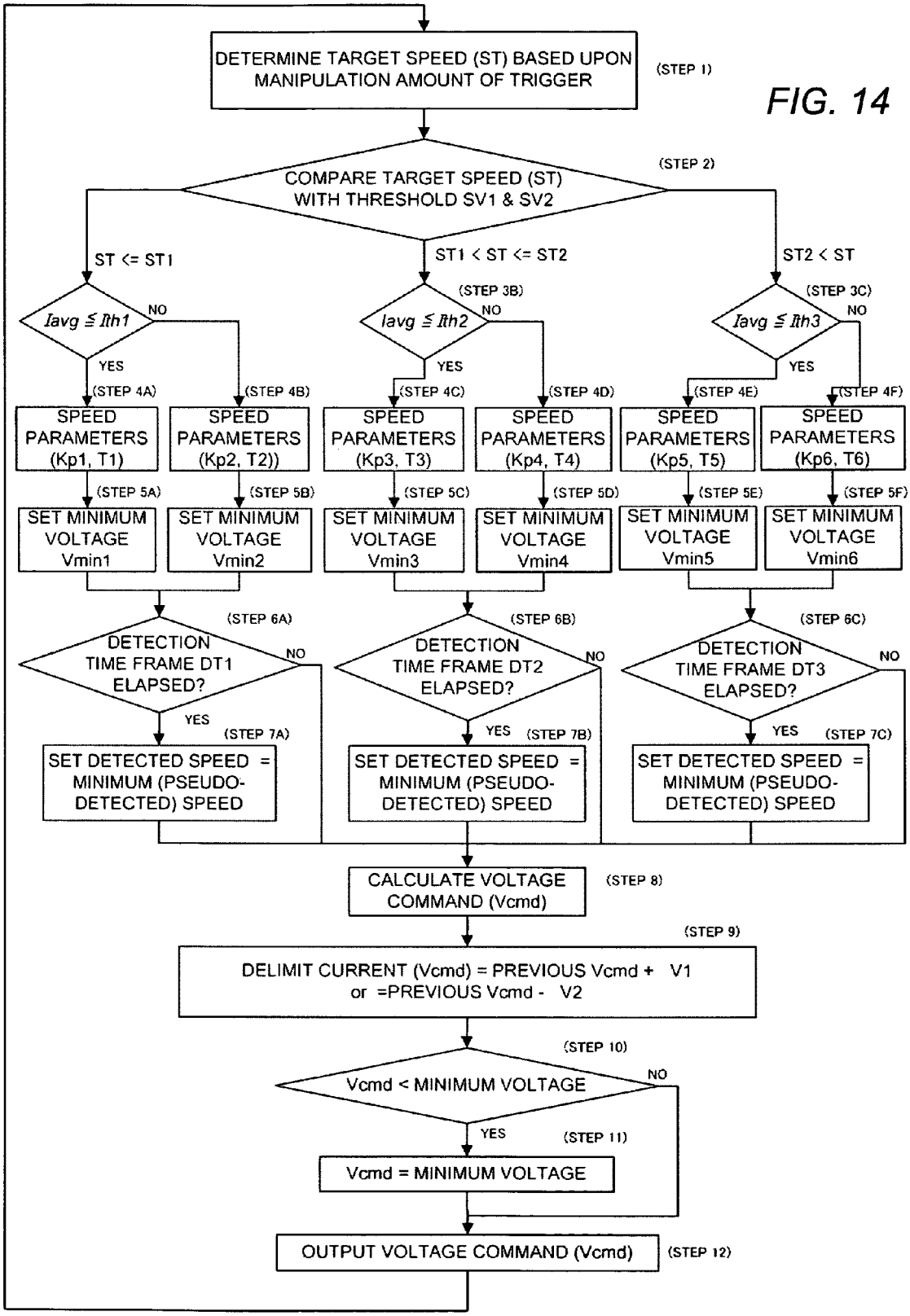
DETERMINE TARGET SPEED (ST) BASED UPON MANIPULATION AMOUNT OF TRIGGER
(STEP 1)
FIG. 14
COMPARE TARGET SPEED (ST) WITH THRESHOLD SV1 & SV2
(STEP 2)
ST <= ST1
ST1 < ST <= ST2
ST2 < ST
Iavg ≦ Ith1
Iavg ≦ Ith2
Iavg ≦ Ith3
(STEP 3B)
(STEP 3C)
NO
YES
(STEP 4A)
(STEP 4B)
(STEP 4C)
(STEP 4D)
(STEP 4E)
(STEP 4F)
SPEED PARAMETERS (Kp1, T1)
SPEED PARAMETERS (Kp2, T2))
SPEED PARAMETERS (Kp3, T3)
SPEED PARAMETERS (Kp4, T4)
SPEED PARAMETERS (Kp5, T5)
SPEED PARAMETERS (Kp6, T6)
(STEP 5A)
(STEP 5B)
(STEP 5C)
(STEP 5D)
(STEP 5E)
(STEP 5F)
SET MINIMUM VOLTAGE Vmin1
SET MINIMUM VOLTAGE Vmin2
SET MINIMUM VOLTAGE Vmin3
SET MINIMUM VOLTAGE Vmin4
SET MINIMUM VOLTAGE Vmin5
SET MINIMUM VOLTAGE Vmin6
(STEP 6A)
(STEP 6B)
(STEP 6C)
DETECTION TIME FRAME DT1 ELAPSED?
DETECTION TIME FRAME DT2 ELAPSED?
DETECTION TIME FRAME DT3 ELAPSED?
(STEP 7A)
(STEP 7B)
(STEP 7C)
SET DETECTED SPEED = MINIMUM (PSEUDO-DETECTED) SPEED
CALCULATE VOLTAGE COMMAND (Vcmd)
(STEP 8)
(STEP 9)
DELIMIT CURRENT (Vcmd) = PREVIOUS Vcmd + V1
or =PREVIOUS Vcmd - V2
(STEP 10)
Vcmd < MINIMUM VOLTAGE
(STEP 11)
Vcmd = MINIMUM VOLTAGE
OUTPUT VOLTAGE COMMAND (Vcmd)
(STEP 12)

ROTARY IMPACT POWER TOOL

TECHNICAL FIELD

The present invention is directed to a rotary impact power tool such as an impact screwdriver, wrench or drill.

BACKGROUND ART

Impact tools have been widely utilized to facilitate drilling and tightening of screws or nuts with the aid of an impact. Japanese Patent Publication JP2005-137134 discloses a typical impact tool which is designed to vary a rotation speed in accordance with a manipulation amount of a trigger button. The impact tool has a motor driving a drive shaft carrying a hammer, and an output shaft holding a tool bit. The hammer is engageable with an anvil fixed to the output shaft in order to give a rotary impact to the output shaft, i.e., the tool bit. The tool includes a speed commander which, in response to the manipulation amount of the trigger button, a speed command designating a rotation speed at which the drive shaft is rotated. Also included in the tool is a speed controller which generates a control signal for rotating the driving shaft at the speed determined by the speed command, while monitoring the speed of the drive shaft. The speed of the drive shaft is detected by a detector which includes magnetic sensors disposed adjacent to a permanent magnet rotor of the motor. The control signal designates a motor voltage to be applied to the motor through a motor controller. Further, the speed controller is configured to have a load detector detecting a load acting on the drive shaft, and to keep the speed of the drive shaft higher than a predetermined minimum speed when the detected load is greater than a predetermined level. This scheme is intended to avoid substantial stalling of the motor under a large load condition, and therefore avoid an erroneous situation of failing to monitor the speed of the drive shaft in order to enable continued impact on the tool bit.

However, when the drive shaft rotates at a relatively low speed while periodically generating the impact by collision of the hammer with the anvil, the speed of the drive shaft is temporarily detected as nearly zero just after giving the impact. With this consequence, the speed controller is unable to generate a proper speed command until the drive shaft starts rotating, thereby causing a response delay and even the temporary stalling of the motor, which would result in irregular and inconsistent impact on the tool bit.

DISCLOSURE OF THE INVENTION

In view of the above problem and insufficiency, the present invention has been accomplished to provide an improved rotary impact power tool which is capable of generating regular and consistent impact even when the drive shaft is rotating at a low speed. The impact power tool in accordance with the present invention includes a motor rotating a drive shaft, an output shaft configured to hold a tool bit, and a hammer coupled to the drive shaft. The hammer is rotatable together with the drive shaft and is engageable with an anvil fixed to the output shaft so as to give a rotary impact to the output shaft as the drive shaft rotates. The tool further includes a trigger which is manipulated by a user to determine a speed index indicative of an intended speed of the drive shaft in proportion to a manipulation amount, a speed commander configured to generate a target speed based upon the speed index, and a speed detector configured to detect a rotation speed of the drive shaft to give a detected speed. Also included in the tool is a speed controller which generates a control signal for driving the motor in order to match the detected speed with the target speed. The speed controller is configured to set a detection time frame, and to adopt a predefined pseudo-detection speed as a substitute for the detected speed when the speed controller receives no detected speed from the speed detector within the detection time frame. The pseudo-detection speed is a minimum speed greater than zero and varies in accordance with the target speed. Accordingly, even if no speed detection continues, i.e., the motor is stalled over the detection time frame, the speed controller can successfully generate the control signal by making the use of the pseudo-detection speed, thereby continuing to rotate the drive shaft for generating the impact regularly and consistently without causing a delay.

Preferably, the detection time frame is set as a function of the speed command. Thus, the tool can give the above effect over a wide range of the rotation speed of the drive shaft or motor, thereby enabling to generate the impact cyclically in accordance with the rotation speed designated by the speed command.

The power tool is preferred to include a load detector for detection of an amount of load acting on the drive shaft. In this connection, the speed controller may be configured to have different control modes which rely respectively upon different speed-control parameters for determination of the control signal. The speed controller selects one of the different control modes based upon the detected load. Thus, the tool is enabled to improve a response for generating the control signal irrespectively of the amount of the load, thereby keeping the regular impact especially when the rotation speed is relatively low under a heavy load condition.

The speed controller may be configured to check whether or not the control signal designates the rotation speed lower than a predetermined minimum speed, and to modify the control signal to designate the minimum speed, in case when the control signal designates the rotation speed lower than the minimum speed. Accordingly, even when the drive shaft is rotating at a relatively low speed, the speed controller can give a sufficient force of rotating the drive shaft immediately after the impact is given to the output shaft, thereby assuring to keep the hammer rotating for generating the impact sufficiently and consistently without a delay.

Further, the speed controller may be configured to update the control signal every predetermined cycle while obtaining a speed difference in the rotation speed designated by the control signals between the current and previous cycles, and to limit the speed difference within a predetermined range. Thus, it is enabled to restrain over-response of varying the rotation speed of the drive shaft, thereby assuring to give a stable and consistent impact motion, especially at a relatively low speed where a relatively large speed difference occurs between immediately before and after the impact is generated.

Still further, the speed commander may be configured to have a plurality of starting speeds, and to select one of the starting speeds as the target speed in accordance with a varying rate of the speed index reaching above a predetermined level. Thus, the drive shaft, i.e., the output shaft can attain the target speed at a rate as intended by the user manipulating the trigger.

In a preferred embodiment, the speed controller is integrated in a power supply circuit together with an inverter and a PWM (pulse-width modulator). The inverter is configured to supply a varying output power to rotate said motor at a varying speed. The PWM is configured to give a PWM signal to the inverter for varying the output power of the inverter in proportion to a varying voltage command input to the PWM. In this instance, the speed controller generates the control signal in the form of a voltage command which is processed to give the minimum speed and to limit the speed difference.

These and still further advantageous features of the present invention will become more apparent from the following description of a preferred embodiment when taking in conjunction with the attached drawings.

BRIEF DESCRIPTION OF THE DRAWINGS

FIG. 14 is a flowchart illustrating an operation sequence of the power tool.

BEST MODE FOR CARRYING OUT THE INVENTION

Figure 1:
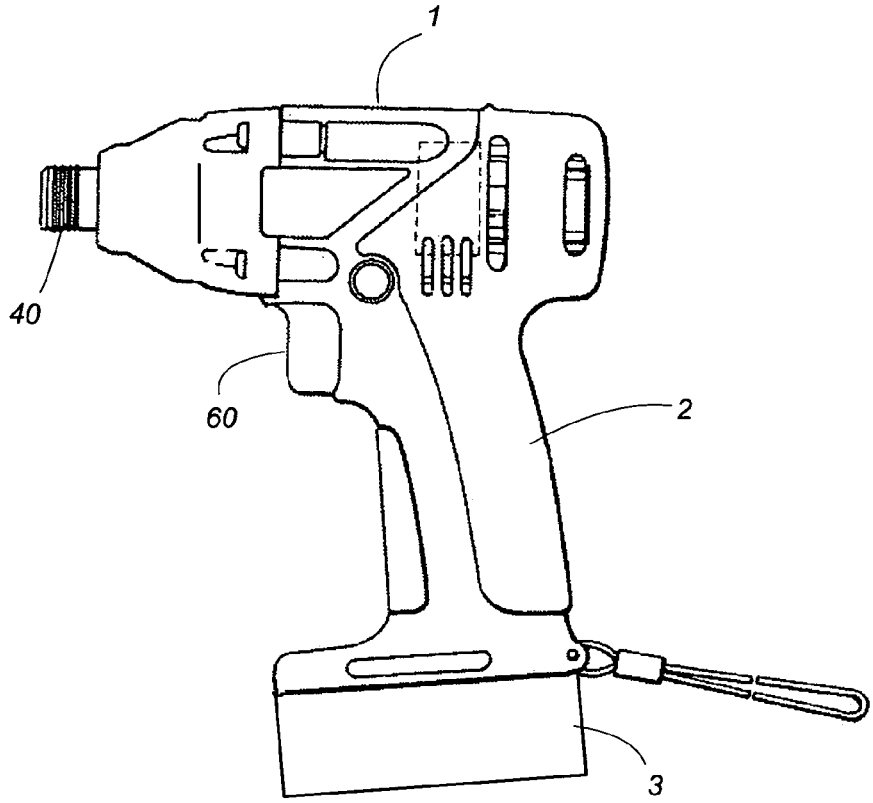
FIG. 1 is a front view of a rotary impact power tool in accordance with the preferred embodiment of the present invention.
Figure 2:
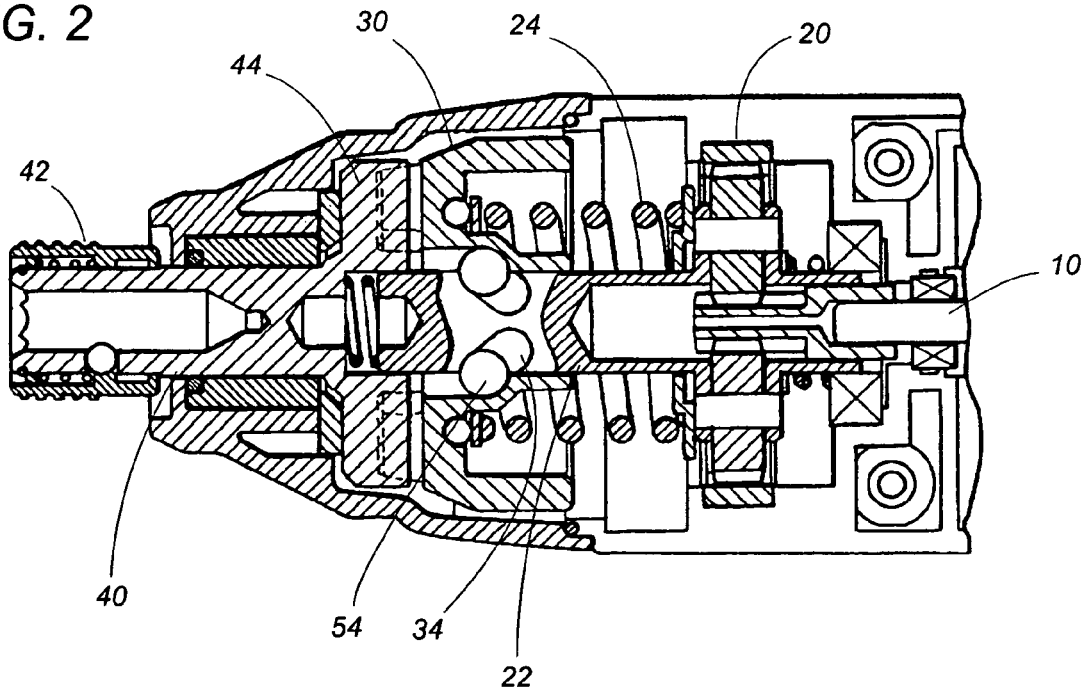
FIG. 2 is a sectional view of a major part of the above power tool.
Figure 3:
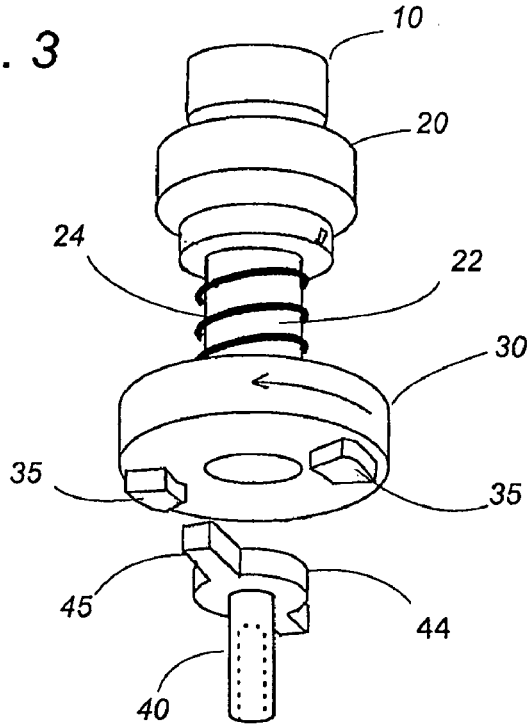
FIG. 3 is a perspective view of an impact drive unit incorporated in the power tool.

Referring now to FIGS. 1 to 3, there is shown a rotary impact power tool in accordance with a preferred embodiment of the present invention. The power tool has a casing with a main body 1 and a hand grip 2. The main body 1 accommodates therein an impact drive unit composed of a brushless three-phase motor 10, a reduction gear 20 with a drive shaft 22, and an output shaft 40 adapted to hold a tool bit (not shown) such as a screwdriver, drill, or wrench bit. The output shaft 40 is held rotatable within the front end of the main body 1 and carries at its front end a chuck 42 for mounting the tool bit. The motor 10 has a rotor carrying permanent magnets and a stator composed of three-phase windings. The rotor is connected to the reduction gear 20 to rotate the drive shaft 22 at a reduced speed. A battery pack 3 is detachably connected to the lower end of the hand grip 2 to supply an electric power to the motor 10.

A hammer 30 is coupled at the front end of the drive shaft 22 through a cam mechanism which allows the hammer 30 to be rotatable together with the drive shaft 22 and also movable along an axis of the drive shaft against a bias of a coil spring 24. The output shaft 40 is formed at its rear end with an anvil 44 which is engageable with the hammer 30 to receive a rotary impact which is transmitted to the tool bit for facilitating the tightening or drilling with the aid of the impact.

Normally, the hammer 30 is kept engaged with the anvil 44 so that the output shaft 40 is caused to rotate together with the drive shaft 22 until the output shaft 40 sees considerable resistive force that impedes the continued rotation of the drive shaft 22 or the motor 10. Upon this occurrence, the hammer 30 is caused to recede axially rearwards to be temporarily disengaged from the anvil 44, and is allowed to rotate relative to the anvil, giving the impact to the output shaft 40, as will be discussed below.

The cam mechanism includes balls 54 which are partly held in an axial groove in the hammer 30 and partially held in an inclined groove 34 in the drive shaft 22 such that the hammer 30 is normally held in its forward most position for engagement with the anvil 44. When the hammer 30 is jammed against the anvil 44, the hammer 30 is temporarily caused to move axially rearwards against the bias of the spring 24 as the rotating drive shaft 22 drag the balls 54 axially rearwards, thereby being permitted to rotate relative to the anvil 44. With this arrangement, the hammer 30 generates and apply a rotary impact to the output shaft 40, i.e., the tool bit though the sequence shown in FIGS. 4A to 4C and 5A to 5C.

Figure 4A:
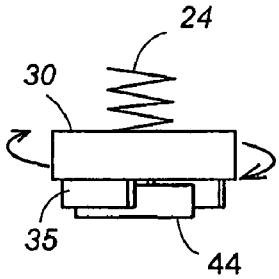
FIGS. 4A to 4C are schematic views illustrating an impact generating operation.
Figure 5A:
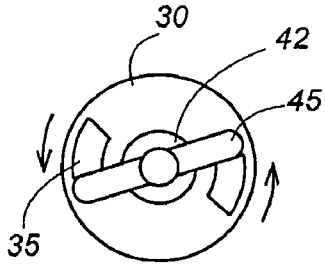
FIGS. 5A to 5C are also schematic views illustrating the impact generating operation.
Figure 4B:
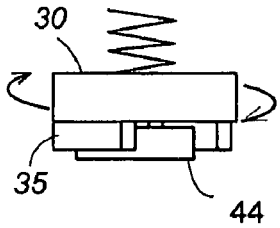
Figure 5B:
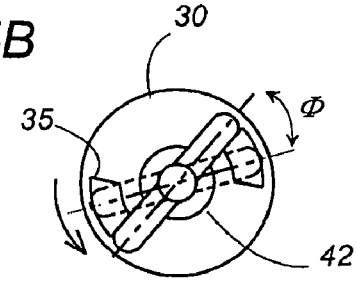
Figure 4C:
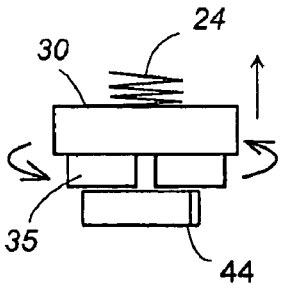
Figure 5C:
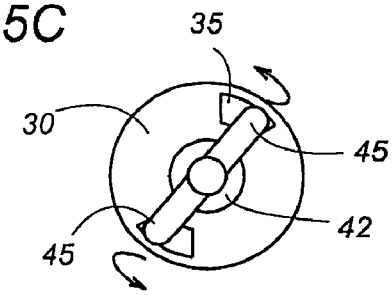

The hammer 30 has a pair of diametrically opposed strikers 35 which strike a corresponding pair of arms 45 formed on the anvil 44 after the hammer 30 rotates relative to the standstill anvil 44, as shown in FIGS. 4A and 5A, thereby generating the rotary impact and subsequently forcing the anvil 44 to rotate by an angle $\phi$, as shown in FIGS. 4B and 5B. The hammer 30 is thereafter kept rotating as the cam mechanism allows the strikers 35 to ride over the arms 45, as shown in FIGS. 4C and 5C. The above sequence is repeated as the hammer 30 is driven to rotate by the motor 10 for applying the rotary impact cyclically to the tool bit through the output shaft 40.

Figure 6:
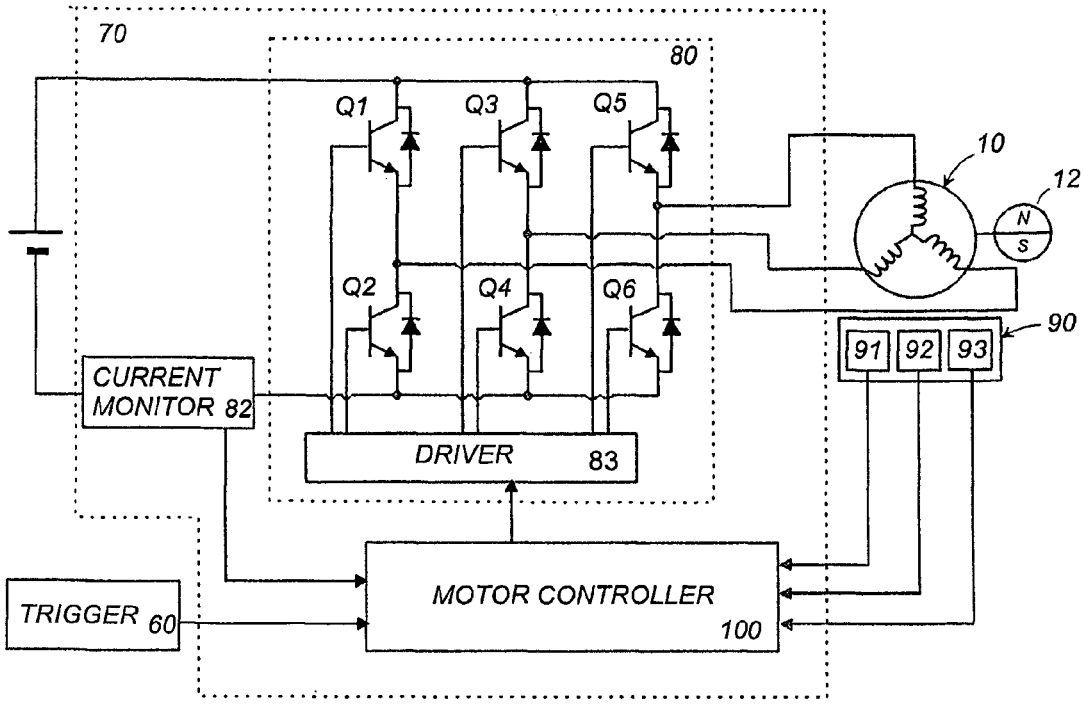
FIG. 6 is a circuit diagram of the above tool.

FIG. 6 illustrates a power supply circuit 70 configured to supply a varying electric power to the motor 10 in order to rotate the motor at a varying speed intended by a user manipulating a switch button at the hand grip 2. The switch button is connected to a trigger 60 which provides a speed index (SI) indicative of an intended speed of the drive shaft 20 as proportional to a manipulation amount or depression amount of the switch button. The power supply circuit 70 includes an inverter 80 composed of three pairs of series-connected transistors Q1 to Q6, each connected across a DC voltage source DC, and a driver 83 which turns on and off the transistors at a varying duty ratio in order to vary the rotation speed of the motor 10, in response to a drive pulse from a motor controller 100.

Figure 7:
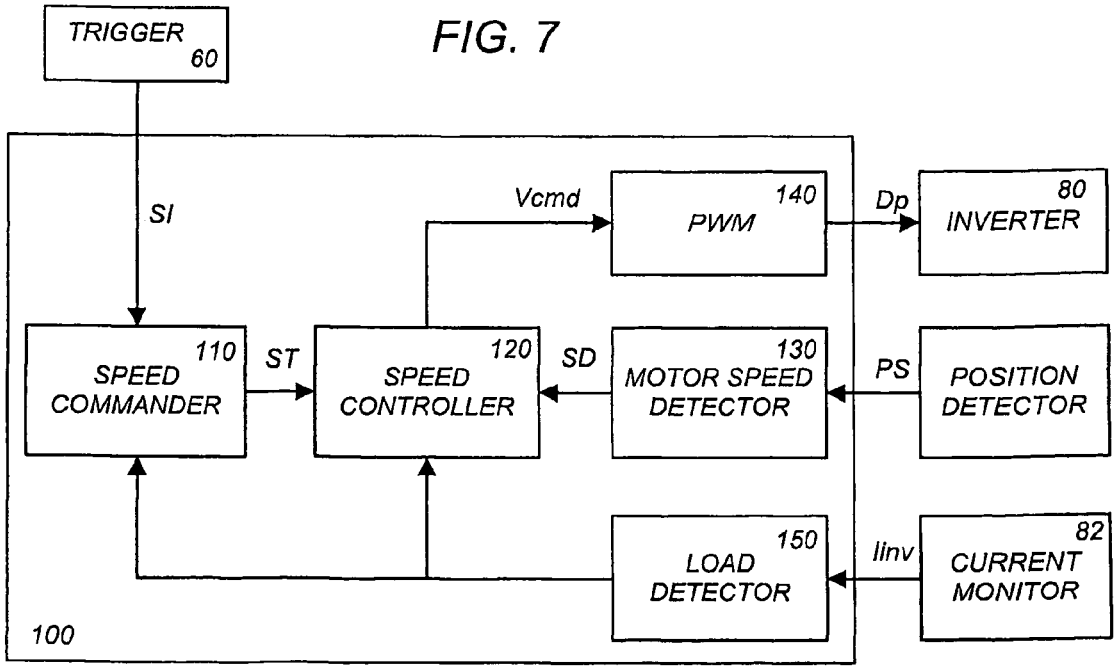
FIG. 7 is a block diagram of a driving circuit incorporated in the above tool.

As shown in FIG. 7, the motor controller 100 includes a speed commander 110, a speed controller 120, a motor speed detector 130, a pulse-width-modulator (PWM) 140, and a load detector 150. The speed commander 110 is connected to receive the speed index (SI) from the trigger 60 to provide a target speed (ST) intended by the user to the speed controller 120. The motor speed detector 130 is connected to receive a position signal (PS) indicating a position of the rotor 12 from a position detector 90 for calculating a current motor speed and provide the detected motor speed (SD) to the speed controller 120. The position detector 90 is configured to include three magnetic pole sensors 91 to 93 for detection of the angular position of the permanent magnets carried on the rotor 12 to generate the position signal (PS). The speed controller 120 is configured to make a proportional-integral (PI) control for the speed of the motor 10, i.e., the drive shaft 22 by minimizing the speed deviation of the detected speed (SD) from the target speed (ST), and to generate and output a control signal in the form of a voltage command (Vcmd) to PWM 140 which responds to give a PWM drive signal Dp to the driver 83 of the inverter 80 in order to rotate the motor 10 at the target speed. For this purpose, the speed controller 120 generates the voltage command (Vcmd) every predetermined cycles (t), which is determined by the following equation.

$$Vcmd(t) = Kp\left[e(t) + \frac{1}{T}\int e(t)dt\right]$$

where

Kp is a proportional part,

T is an integration time, and e(t) is the speed deviation between the instant target speed (ST) and the instant detected speed (SD).

The load detector 150 is configured to detect an amount of load being applied to the motor 10, i.e., the drive shaft 22 as a counteraction from the tool bit or the output shaft. The load is calculated based upon a current (Iinv) which is flowing through the inverter 80 and is monitored by a current monitor 82. The load detector 150 averages the continuously monitored current (Iinv) to give an average load current Iavg to the speed controller 120 as well as the speed commander 110. The speed controller 120 is configured to adjust the voltage command (Vcmd) in consideration of the average load current (Iavg), by selecting one of different speed control parameter sets with regard to the above equation, depending upon the average load current (Iavg), and also upon the target speed (ST), as shown in Table 1 below.

TABLE 1

| Target speed | Average load | Speed control parameters | |
|---|---|---|---|
| (ST) | current <Iavg> | Proportional part | Integration time |
| ST ≦ ST1 | Iavg ≦ Ith1 | Kp1 | T1 |
| | Iavg > Ith1 | Kp2 (>Kp1) | T2 (<T1) |
| ST1 < ST ≦ ST2 | Iavg ≦ Ith2 | Kp3 | T3 |
| | Ilavg > Ith2 | Kp4 (>Kp3) | T4 (<T3) |
| ST2 < ST | Iavg ≦ Ith3 | Kp5 | T5 |
| | Iavg > Ith3 | Kp6 (>Kp5) | T6 (<T6) |

The speed controller 120 is programmed to have three thresholds (Ith1<Ith2<Ith3) for comparison with the average load current (Iavg). As is clear from the above equation, the voltage command Vcmd will become greater with the increasing proportional part Kp, and the decreasing integration time T.

Figure 8:
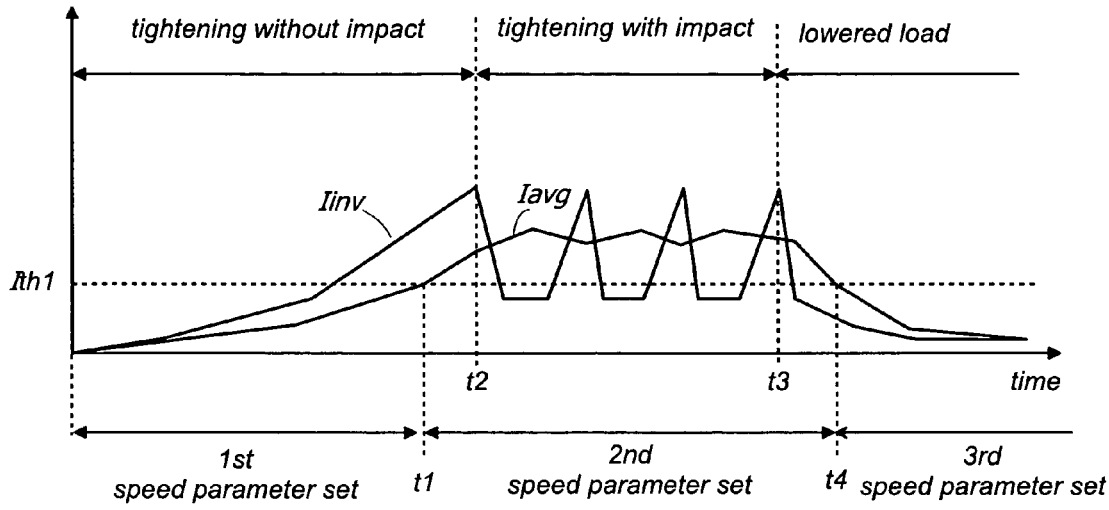
FIG. 8 is a graph illustrating an impact operation of the power tool.

It is noted in this connection that, during a tool operation, the average load current Iavg become greater as the operation is accompanied with the impact than at the operation without the impact, as shown in FIG. 8. For example, when tightening a screw, the output shaft 40 rotates as being kept in constant engagement with the drive shaft 22 without the impact so as to advance the screw to a certain extent, during which only small load current Iavg is seen. When the output shaft 40 is jammed due to increased resistance, the hammer 30 is caused to start giving the impact to further tighten the screw. Upon starting the impact, the average load current (Iavg) increases as the instantaneous load current (Iinv) repeats rapid rising and falling. This continues until finishing the tool operation, as seen in the figure.

In well consideration of the load condition as represented by the average load current (Iavg), the speed controller 120 is configured to hasten the motor 10 to reach the target speed while giving the impact periodically, thereby shortening a dead time in which no speed detection is available due to the temporary stalling of the motor 10 just after the hammer 30 strikes the anvil 44 and until the hammer 30 rides over the anvil 44. With this consequence, the impact can be generated regularly and consistently with the speed of the motor as intended by the user, as shown in the figure in which the detected speed is shown to drop rapidly each after the impact is made.

Figure 9:
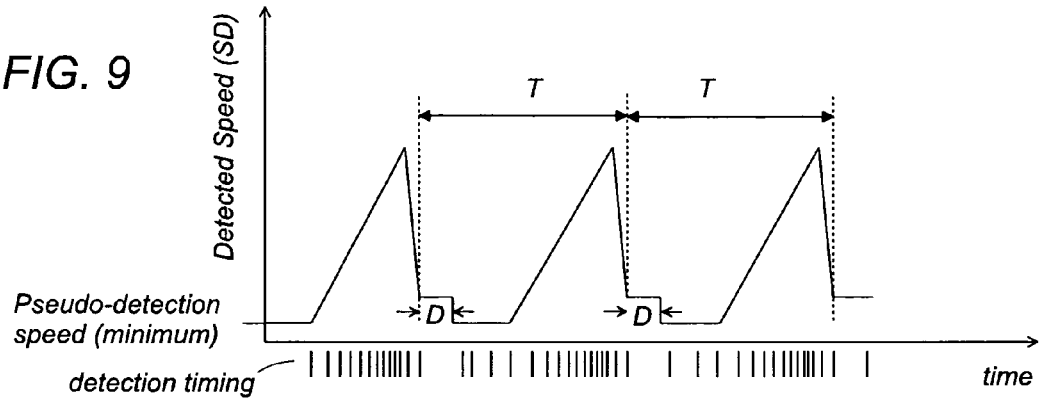
FIGS. 9 and 10 are graphs illustrating impact operations of the power tool respectively with and without a speed control based upon a detected load.
Figure 10:
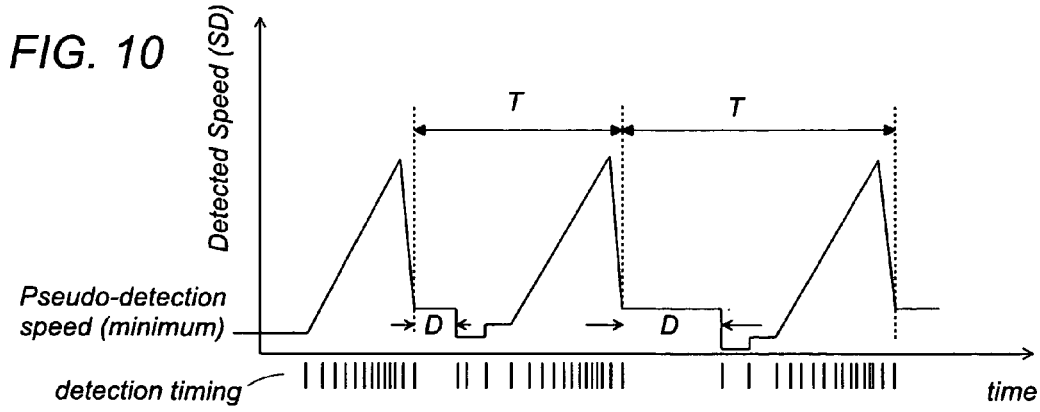

For this purpose, the speed controller 120 relies upon a first speed parameter set of Kp1 and T1 until the impact is first to be made, i.e., until the average load current Iavg exceeds a predetermined threshold Ith1 at time t1, as shown in FIG. 8. The first impact is made at time t2 immediately after time t1. Once the average load current Iavg exeeds Ith1, the speed controller 120 selects a second speed parameter set of Kp2 and T2 which expedite the motor 10 to reach the target speed, i.e., a speed-control response than the standard speed parameter set, thereby shortening the dead time D, as is clear from the comparison of FIG. 9 with FIG. 10 which shows the detected speed of the motor in the absence of varying the speed control parameters depending upon the load condition. Accordingly, it is possible to generate the impact at a regular interval (T), as shown in FIG. 9. After releasing the tool from the screw or lowering the target speed at time t3, the average load current (Iavg) is lowered below the threshold Ith1 so that the speed controller 120 selects a third speed parameter set to lower the speed response.

As listed in Table 1, different one of the speed control parameter sets are provided and is selected also depending upon the target speed (ST). The integration time T is set to be shorter as the target speed (ST) increases.

Further, in order to make a consistent speed control, the speed controller 120 is configured to hold a pseudo-detection speed which is utilized as a substitute for the detected speed (SD) when the detected speed (SD) is not available over a predetermined detection time frame (DT). The pseudo-detection speed is set to be a minimum speed above zero and is defined as a function of the target speed (ST). Also, the detection time frame (DT) is set as a function of the target speed (ST), i.e., voltage command (Vcmd). With this arrangement, the speed controller 120 is enabled to generate effective voltage command (Vcmd) with the use of the minimum detection speed, even if the detection speed is not available from the motor speed detector 130 for a short time period as a consequence of that the motor is stalling just after the generation of the impact, thereby minimizing the delay of the motor reaching the target speed again and therefore assuring to generate the impact regularly and consistently as intended by the target speed. This is particularly advantageous for the tool operation at a low speed where such delay would otherwise give rise to considerable fluctuation of the impacting cycle. Further, since the detection time frame is set to vary as a function of the target speed (ST), the above delay can be minimized in well consideration of the target speed to assure the consistent impact operation over a wide range of the target speed.

In this connection, the speed controller 120 is also configured to check whether or not the control signal, i.e., voltage command Vcmd designates the rotation speed lower than a predetermined minimum speed, and to modify the voltage command Vcmd to designate the minimum speed, i.e., a corresponding minimum voltage Vmin in case when the voltage command Vcmd designates the rotation speed lower than the minimum speed (Vcmd<Vmin). When the drive shaft or motor 10 is rotating at a relatively low speed, the detected speed will drop nearly to zero after the hammer 30 generates the impact. In the absence of the above scheme of modifying the voltage command Vcmd, it is possible that the resulting voltage command Vcmd might be lowered to such an extent that the hammer 30 or the drive shaft 22 loses its rotation speed, failing to give an intended impact in subsequent cycle or to generate the impact at an intended timing. This insufficiency has been overcome in the present embodiment so that the speed controller 120 can give a sufficient force of rotating the drive shaft immediately after the impact is given to the output shaft 40, thereby assuring to keep the hammer 30 rotating relative to the anvil 44 to generate the sufficient impact without a delay. The minimum speed may be fixed irrespectively of the target speed (ST) and the load condition, or may be set to vary depending upon the target speed (ST) and the average load current as shown in Table 2 below.

TABLE 2

| Target speed (ST) | Average load current <Iavg> | Minimum voltage Vmin (minimum speed) |
|---|---|---|
| ST ≦ ST1 | Iavg < Ith1 | Vmin1 |
| | Iavg ≧ Ith1 | Vmin2 |
| ST1 < ST ≦ ST2 | Iavg < Ith2 | Vmin3 |
| | Ilavg ≧ Ith2 | Vmin4 |
| ST2 < ST | Iavg < Ith3 | Vmin5 |
| | Iavg ≧ Ith3 | Vmin6 |

Figure 11:
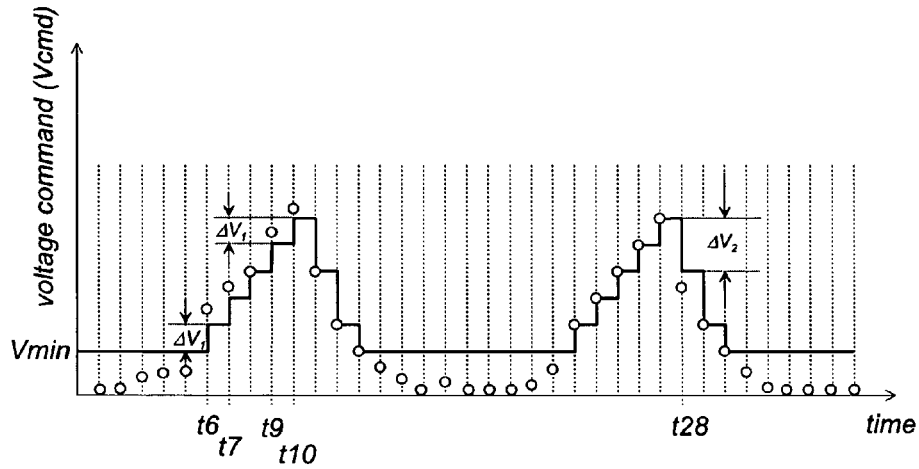
FIG. 11 is a graph illustrating a speed control operation of the power tool.

As shown in FIG. 11, the speed controller 120 is configured to update the voltage command Vcmd at every cycle defined by a clock signal given to the speed controller 120. In each cycle, the speed controller 120 calculates a voltage difference, i.e., a speed difference between the voltage command Vcmd of the current cycle and that of the previous cycle, and to limit the voltage difference (speed difference) within a predetermined range. For example, when the current voltage command Vcmd (indicated by white dots in the figure) exceeds the previous voltage command by an extent greater than a predetermined limit value ($\Delta V_1$), seen at time t6, t7, t9, and t10, the speed controller 120 delimits the current voltage command to be previous voltage command plus the limit value of $\Delta V_1$(current Vcmd=previous Vcmd+$\Delta V_1$). Also, when the current voltage command Vcmd goes down below the previous one by an extent greater than a predetermined limit value ($\Delta V_2$), as seen as time t28, the current voltage command Vcmd is delimited to be the previous voltage command Vcmd minus the limit value of $\Delta V_2$(current Vcmd=previous Vcmd−$\Delta V_2$) This arrangement enables to restrain over-response of varying the rotation speed of the drive shaft, and therefore to assure a stable and consistent impact motion. It is noted here that the voltage command Vcmd may be delimited only in a direction of increasing the voltage command.

Figure 12:
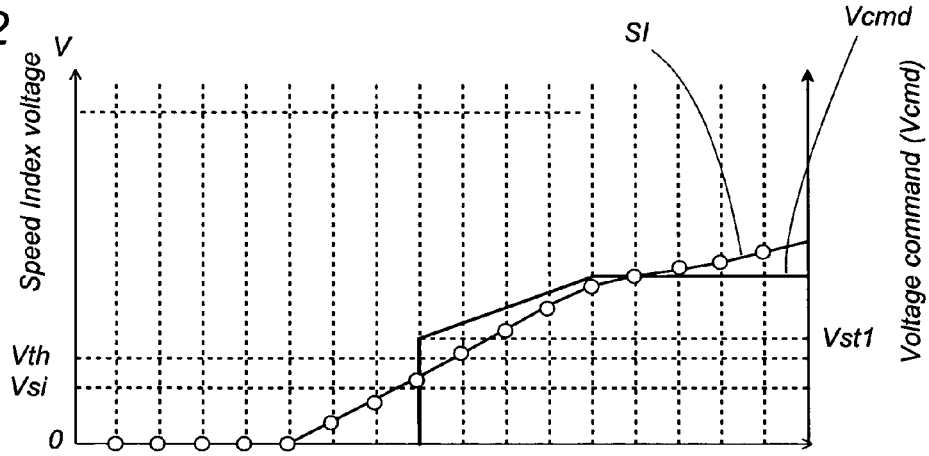
FIGS. 12 and 13 are graphs illustrating starting operation of the power tool.
Figure 13:
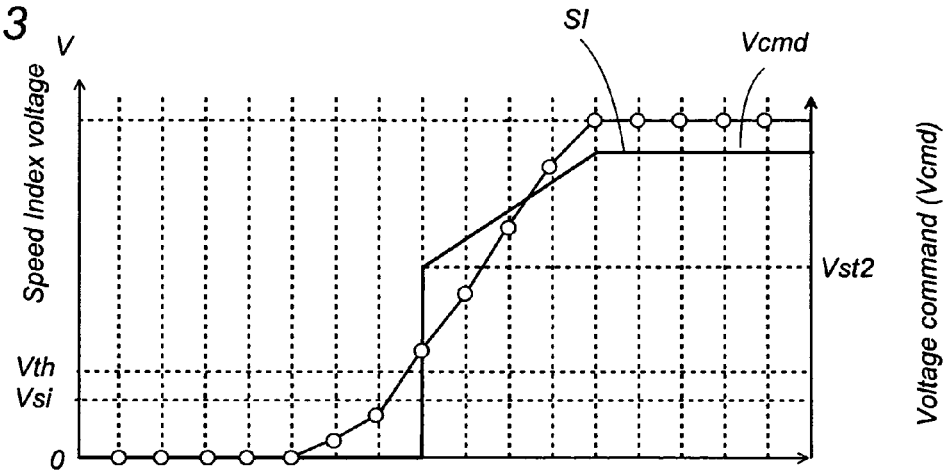

Still further, the speed commander 110 is configured to give the target speed (ST) in the form of a target voltage and to have a plurality of starting voltages (Vst1, Vst2) one of which is selected as the target voltage at the time of starting the motor 10. The selection of the starting voltage is made according to a rate of the speed index (SI) also provided in the form of a voltage reaching above a zero-speed voltage (Vsi) which indicates zero-speed of the motor 10. That is, when the speed index voltage first goes above the zero-speed voltage (Vsi), it is compared with a predetermined threshold (Vth). When the speed index voltage is found to be greater than the threshold, the speed commander 110 selects a first starting voltage (Vst1) as the target voltage, as shown in FIG. 12, in view of that the user intends to increase the speed gradually. Thus, the speed controller 120 generates and provide the voltage command Vcmd (=target voltage Vst1) to the PWM 140 for starting the motor 10. Otherwise, the speed controller 110 selects a second starting voltage (Vst2) as the target voltage, as shown in FIG. 13, in view of that the user intends to increase the speed rapidly. It is noted here that the voltage command (Vcmd) will follow the speed index (SI) as being modified according to the varying load acting on the motor, as discussed in the above.

The above operations of the power tool are summarized in the flow chart of FIG. 14. First, the speed commander 110 determines the target speed (ST) based upon the speed index (SI) from the trigger 60 at step 1. Then, the speed controller 120 compares the target speed (ST) with predetermined thresholds (ST1 and ST2) at step 2, followed by steps 3A to 3C where the average load current (Iavg) is compared respectively with thresholds (Ith1, Ith2, Ith3). Based upon the comparison result, the speed controller 120 determines one of the speed control parameter sets (Kp1, T1), (Kp2, T2), (Kp3, T3), (Kp4, T4), (Kp5, T5), (Kp6, T6) at step 4A to 4F, followed by steps 5A to 5F where the speed controller 120 set a minimum voltage (Vmin1 to Vmin6) depending upon the comparison results to be referred later. Thereafter, at steps 6A to 6C, the speed controller 120 checks whether or not the detection time frame DT1, DT2, and DT3, which are respectively set as a function of target speed, has elapsed. If the detection time frame has passed without receiving the detected speed (SD) from the motor speed detector 130, the speed controller 120 relies upon the pseudo-detected voltage as a substitute for the detected voltage (SD) at step 7A to 7C, in order to calculate the voltage command (Vcmd) at step 8 for enabling the P-I control of the motor. If the detection time frame is not elapsed, the sequence goes directly to step 8 to calculate the voltage command (Vcmd).

Each time the voltage command (Vcmd) is updated, the current voltage command is compared with the previous voltage command at step 9 to delimit the current voltage command such that the current voltage (Vcmd)=previous voltage command (Vcmd)+ΔV1 in case the motor speed is increasing, and the current voltage command (Vcmd)=previous voltage command (Vcmd)−ΔV2 in case the motor speed is decreasing. At the subsequent step 10, the updated voltage command (Vcmd) is validated whether it is lower than the predetermined minimum voltage obtained at step 5A to 5F. If the current voltage command (Vcmd) is found to be less than the minimum voltage, it is set to be the minimum voltage at step 11. Otherwise, the current voltage command is adopted. Finally, the voltage command (Vcmd) thus determined and validated is fed at step 12 to the PWM 140 for causing the motor to rotate at the target speed (ST). The above cycles are repeated to control the motor during the tool operation.

The invention claimed is:

1. A rotary impact power tool comprising:

a motor;

a drive shaft configured to be driven to rotate by said motor;

an output shaft configured to hold a tool bit, said output shaft being provided with an anvil, a hammer coupled to said drive shaft to be rotatable together with said drive shaft, said hammer configured to be engageable with said anvil to give a rotary impact to said output shaft as said drive shaft rotates;

a trigger configured to be manipulated by a user to give a speed index indicative of an intended speed of said drive shaft in proportion to a manipulation amount of said trigger;

a speed commander configured to generate a target speed based upon said speed index;

a speed detector configured to detect a rotation speed of said drive shaft to give a detected speed;

a speed controller configured to generate a control signal which drives said motor in order to match said detected speed with said target speed; wherein said speed controller is configured to set a detection time frame, and to use a predefined pseudo-detection speed as a substitute for said detected speed when said speed controller receives no detected speed from said speed detector within said detection time frame, said pseudo-detection speed being a minimum speed greater than zero and being set to vary depending upon the target speed.

2. The rotary impact power tool as set forth in claim 1, wherein said detection time frame is set as a function of said target speed.

3. The rotary impact power tool as set forth in claim 1, wherein said power tool further includes a load detector configured to detect a load acting on said drive shaft;

said speed controller is configured to have different control modes which rely respectively upon different speed-control parameters for determination of said control signal, and to select one of said different control modes based upon the detected load.

4. The rotary impact power tool as set forth in claim 1, wherein said speed controller is configured to check whether or not said control signal designates the rotation speed lower than a predetermined minimum speed, and to modify said control signal to designate said minimum rotation speed in case when said control signal designates the rotation speed lower than said minimum rotation speed.

5. The rotary impact power tool as set forth in claim 1, wherein said speed controller is configured to update said control signal every predetermined cycle to obtain a speed difference in the rotation speed designated by said control signals between current and previous cycles, and is configured to limit the speed difference within a predetermined range.

6. The rotary impact power tool as set forth in claim 1, wherein said speed commander is configured to have a plurality of starting speeds, and to select one of said starting speeds as said target speed in accordance with a varying rate of said speed index reaching above a predetermined level.

7. The rotary impact power tool as set forth in claim 4, wherein said tool includes a power supply circuit which comprises an inverter configured to supply a varying output power to rotate said motor at a varying speed; and a motor controller provided with said speed controller and a PWM (pulse-width modulator) which is configured to give a PWM signal to said inverter for varying said output power in proportion to a varying voltage command input to said PWM;

said speed controller being configured to provide said control signal in the form of said voltage command, said speed controller being configured to check whether or not said voltage command is lower than a predetermined minimum voltage, and to modify said voltage command as said minimum voltage.

8. The rotary impact power tool as set forth in claim 5, wherein said tool includes a power supply circuit which comprises an inverter configured to supply a varying output power to rotate said motor at a varying speed; and a motor controller provided with said speed controller and a PWM (pulse-width modulator) which is configured to give a PWM signal to said inverter for varying said output power in proportion to a varying voltage command input to said PWM;

said speed controller being configured to provide said control signal in the form of said voltage command, said speed controller being configured to update said voltage command every predetermined cycle to obtain a voltage difference in said voltage command between next and current cycles, and is configured to limit the voltage difference within a predetermined range.

9. The rotary impact power tool as set forth in claim 6, wherein said tool includes a power supply circuit which comprises an inverter configured to supply a varying output power to rotate said motor at a varying speed; and a motor controller provided with said speed controller and a PWM (pulse-width modulator) which is configured to give a PWM signal to said inverter for varying said output power in proportion to a varying voltage command input to said PWM;

said speed commander being configured to give said target speed in the form of a target voltage, said speed commander being configured to have a plurality of starting voltages, and to select one of one of said starting voltages as said target voltage, in accordance with a varying rate of said speed index reaching above a predetermined level.

* * * * *